United States Patent [19]

Emmert

[11] 4,191,111

[45] Mar. 4, 1980

[54] BENCH FOLDING LEG AND BRACE STRUCTURE

[76] Inventor: Raymond L. Emmert, 8112 NW. 19, Oklahoma City, Okla. 73127

[21] Appl. No.: 19,210

[22] Filed: Mar. 9, 1979

Related U.S. Application Data

[63] Continuation of Ser. No. 870,159, Jan. 17, 1978, abandoned.

[51] Int. Cl.[2] ..... A47B 3/00

[52] U.S. Cl. ..... 108/132; 248/188.5; 248/408; 248/411; 248/439; 248/440

[58] Field of Search ..... 108/129–133, 108/146; 248/188.5, 188.6, 407–409, 411, 439, 440

[56] References Cited

U.S. PATENT DOCUMENTS

| | | | |
|---|---|---|---|
| 1,757,260 | 5/1930 | Silverman | 108/132 |
| 1,778,124 | 10/1930 | Saver | 108/132 |
| 3,410,232 | 11/1968 | Krueger | 108/146 |
| 3,469,870 | 9/1969 | Barkus | 248/407 X |

*Primary Examiner*—James C. Mitchell
*Attorney, Agent, or Firm*—Robert K. Rhea

[57] ABSTRACT

A collapsible leg structure for one end of a bench, table, work surface, or the like, including a T-shaped brace rod having one end of its stem pivotally connected to the underside of the bench and its other end lockingly engaged with the depending end portion of the legs. A strut, pivotally connected with the stem of the brace rod, is slidably engaged with a track bracket secured to the undersurface of the bench to limit downward movement of the brace rod with respect to the bench. Links connecting the legs to the strut collapse the legs to a folded position under the bench when the brace rod is manually released from the legs and moved toward the underside of the bench.

11 Claims, 8 Drawing Figures

BENCH FOLDING LEG AND BRACE STRUCTURE

This is a continuation, of application Ser. No. 870,159, filed Jan. 17, 1978 now abandoned.

BACKGROUND OF THE INVENTION

1. Field of the Invention

The present invention relates to table or bench construction and more particularly to a folding leg and brace structure for a bench, or the like.

2. Description of the Prior Art

The prior art such as U.S. Pat. Nos. 1,888,117; 2,969,249; 2,875,007 and 3,777,675 generally disclose toggle joint forming members for bracing folding table legs in vertical depending relation with respect to the plane of the table top when erected. Such folding leg brace structure has not generally been used on benches principally for the reason that legs depending vertically from each end of the bench do not satisfactorily prevent upsetting the bench because of its width with respect to its length. This disadvantage being overcome in folding legs for tables by disposing the legs adjacent the respective marginal side edge of the respective end of the table as in U.S. Pat. No. 1,888,117 or interconnecting the depending end of the legs by a cross bar as in U.S. Pat. Nos. 2,969,249 or 2,875,007.

This invention is distinctive over folding leg and brace structure shown by the prior art by connecting a pair of legs to the respective end portion of a bench in a manner to diverge downward, laterally and longitudinally of the bench when extended and to be folded against the bottom of the bench in parallel relation when collapsed by the movement of one end portion of a brace rod structure toward and away from the underside of the bench. The brace rod structure interconnects the depending end portions of each pair of legs when erected.

SUMMARY OF THE INVENTION

In the preferred embodiment an elongated bench of substantially channel-shape transverse section is provided at its respective ends with a leg bracket for pivotal connection with the upper end of a pair of legs in a manner permitting the legs to diverge downward, laterally and longitudinally of the bench when erected and to lie in parallel relation against the underside of the bench between the legs of the channel-shape when folded. A T-shaped brace rod, pivotally connected by its stem end to the underside of the bench, has its bar end cooperating with lock pins to form a rigid connection with the depending end portion of the respective pair of legs when erected. A strut pivotally connected with the stem of the brace rod and slidably engaging a track bracket secured to the underside of the bench limits movement of the brace rod away from the bench. Links extending between and pivotally connecting the respective legs with the strut pivot the legs toward an erected or collapsed position by movement of the bar end portion of the brace rod toward and away from the underside of the bench. Each leg is provided with a telescoping extension leg for elevating the bench. Side rails, supported by the longitudinal sides of the bench and engageably supported by the depending end portion of the bench legs at the respective side of the bench, form a step support when the leg extensions are extended.

The principal objects of this invention are to provide a folding bench leg and brace structure which is easily erected and collapsed by manual movement of a brace rod toward and away from the underside of each end portion of the bench; is sturdily constructed and normally prevents upsetting of the bench when erected; and, permits the bench to occupy a minimum of space when the leg brace structure is collapsed.

DESCRIPTION OF THE PREFERRED EMBODIMENT

Figure 1:
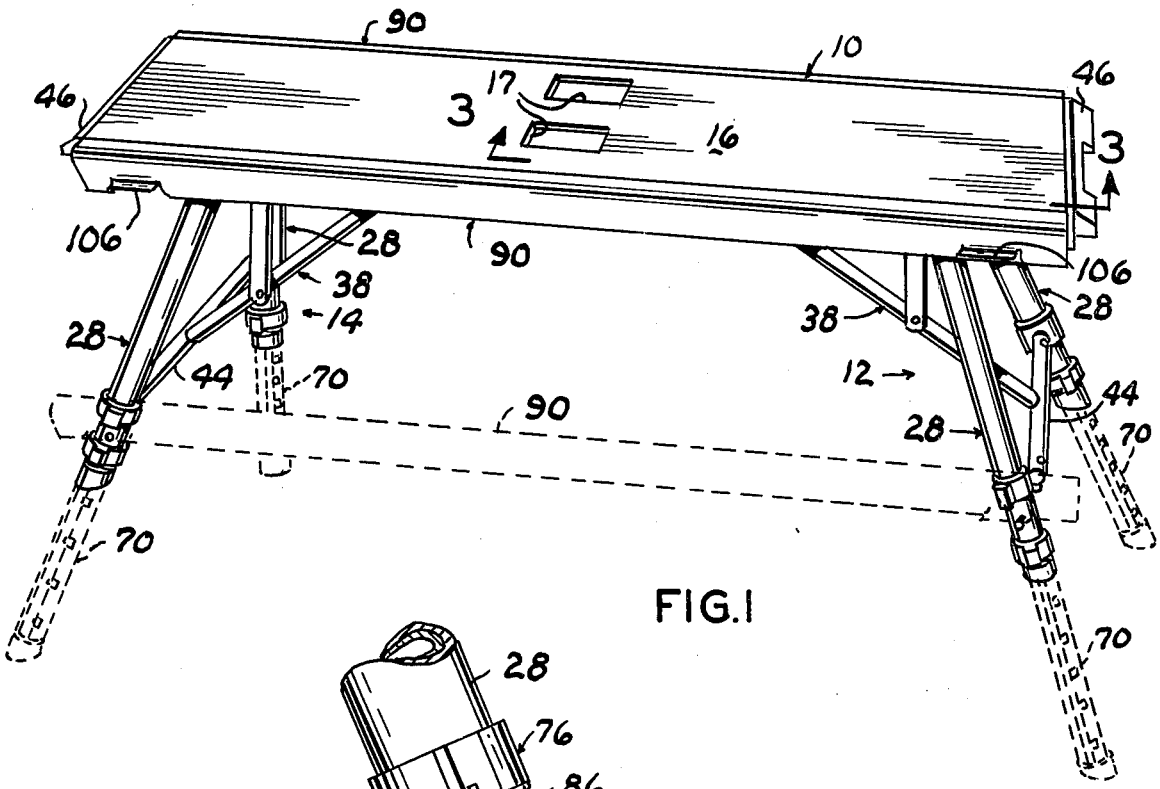
FIG. 1 is a perspective view of the bench in leg erected position illustrating, by dotted lines, the telescoping leg extensions in extended position and one of the side rails forming a step support.

Like characters of reference designate like parts in those figures of the drawings in which they occur.

In the drawings:

Referring more particularly to FIGS. 1 to 4, the reference numeral 10 indicates the bench, as a whole, supported by a pair of folding leg and brace structures 12 and 14. The bench 10 is substantially channel-shaped in transverse section (FIG. 4) having a horizontal top 16 of uniform thickness having hand grip forming holes 17 medially its ends and defining a depending surface or underside 18, parallel depending channel legs 20 and depending end walls 22. Each of the end walls 22 is provided with a downwardly open slot 23 for the purpose presently apparent.

The brace structures 12 and 14 are substantially identical and in the interest of brevity, only the brace structure 12 will be described in detail.

Figure 2:
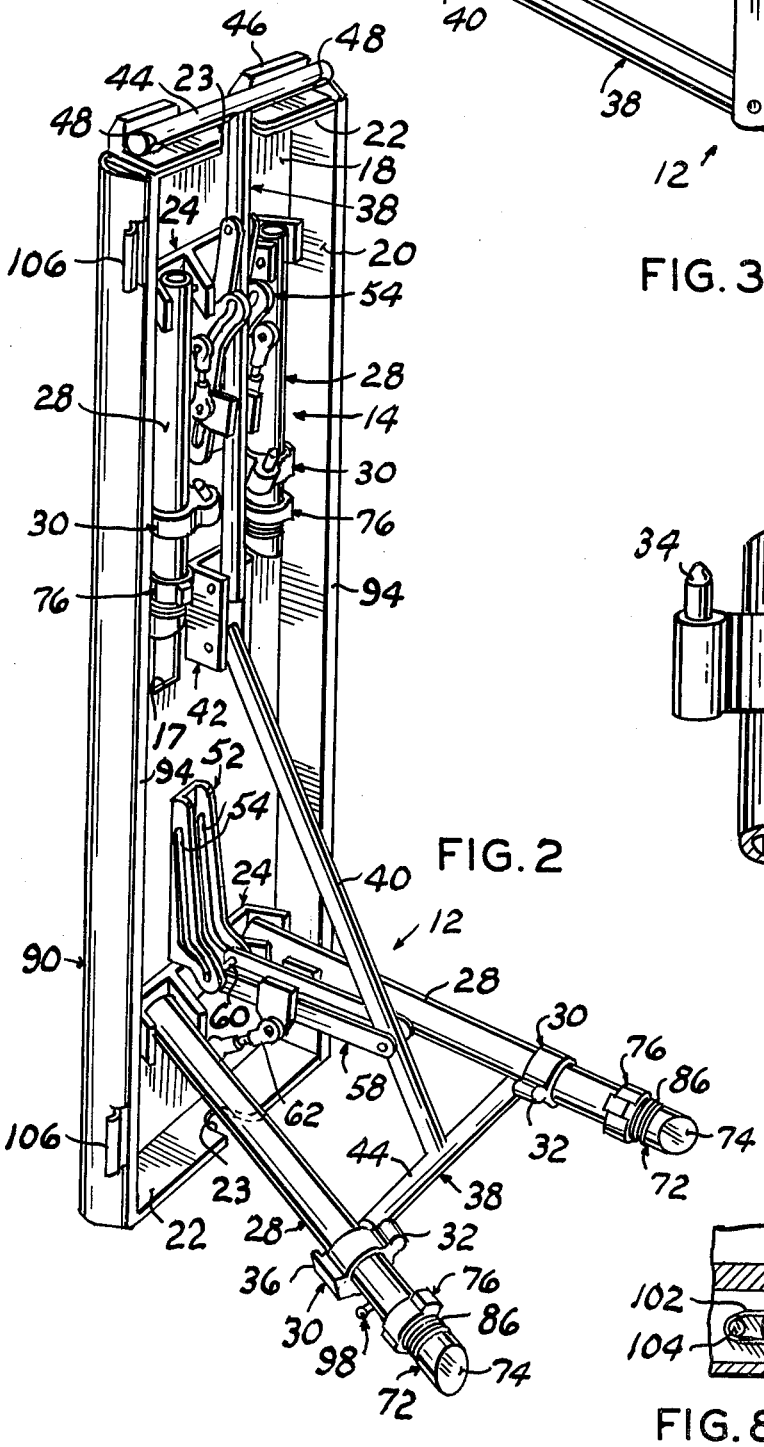
FIG. 2 is a perspective view of the underside of the bench illustrating one pair of legs in erected position and the other pair of legs in folded position.

A leg bracket 24 is transversely connected to the bench underside 18 adjacent one end portion of the bench. The leg bracket 24 is characterized by two spaced-apart pairs of clevis arms 26 projecting downwardly from the bench underside 18 in lateral diverging relation. Each pair of clevis arms 26 are parallel. A pair of tubular legs 28 are pivotally connected at their respective upper end portions between the respective pair of clevis arms 26 on a transverse axis normal to the clevis arms and laterally inclined with respect to the plane of the bench underside 18 for pivoting movement toward and away from the bench underside 18. The pair of legs 28, when erected, diverge downwardly laterally and longitudinally with respect to the top of the bench. When folded against the bench underside 18, the legs lie in spaced-apart parallel relation (FIG. 2). The depending end portion of each leg 28 is provided with a surrounding fixed position collar 30. Each of the collars 30 is characterized by an inner extension 32 having a lock pin 34 secured thereto projecting generally toward the pivotally connected end of the respective leg. The extensions 32 may be a lug-like extension secured to the respective leg. The collars 30 are further characterized by an upwardly open hook receiving recess 36 opposite the lock pin 34 for the purpose presently explained. Obviously, a single leg, not shown, having a support end portion extending transversely of the bench, may be used in place of the respective pairs of legs.

Brace rod means 38 including a T-shaped brace rod, has one end portion of its stem 40 pivotally connected between the legs of a channel-shaped brace rod bracket 42 longitudinally secured to the bench underside 18 between the hand grip holes 17 with the brace rod cross bar 44 disposed transversely of the bench for vertical pivoting movement of the brace rod toward and away from the bench underside. The overall length of the brace rod, with respect to the bench, is such that its stem 40 is disposed between the pair of legs 28 and the cross bar 44 of the T-shape frictionally engages a brace rod latch element 46, preferably formed from resilient material, such as rubber, having a central downwardly open slot cooperatively aligned with the end wall slot 23 and coextensive with and secured to the outer surface of the bench end wall 22. The respective end portion of the cross bar 44 is provided with an aperture 48 for cooperative reception of the respective lock pin 34 thus locking the legs when in an erected position, as presently explained. Obviously the lock pins 34 may be secured to the cross bar 44 at the position of the apertures 48 and a lock pin receiving aperture formed in the respective lug-like collar extension 32.

Link and track bracket means 50 interconnects the brace rod means 38 and legs 28 with the bench underside 18. The link and track bracket means 50 comprises an elongated track bracket 52 longitudinally secured to the bench underside 18 medially its width and between the leg bracket 24 and brace rod bracket 42. The track bracket 52 is channel-shaped in transverse section having the depending legs thereof cooperatively slotted transversely, intermediate their ends, as at 54. The slots 54 are inclined with respect to the bench underside 18 and terminate toward the leg bracket 24 in a horizontal plane forming an idler area 56 for the purposes presently explained.

Figure 3:
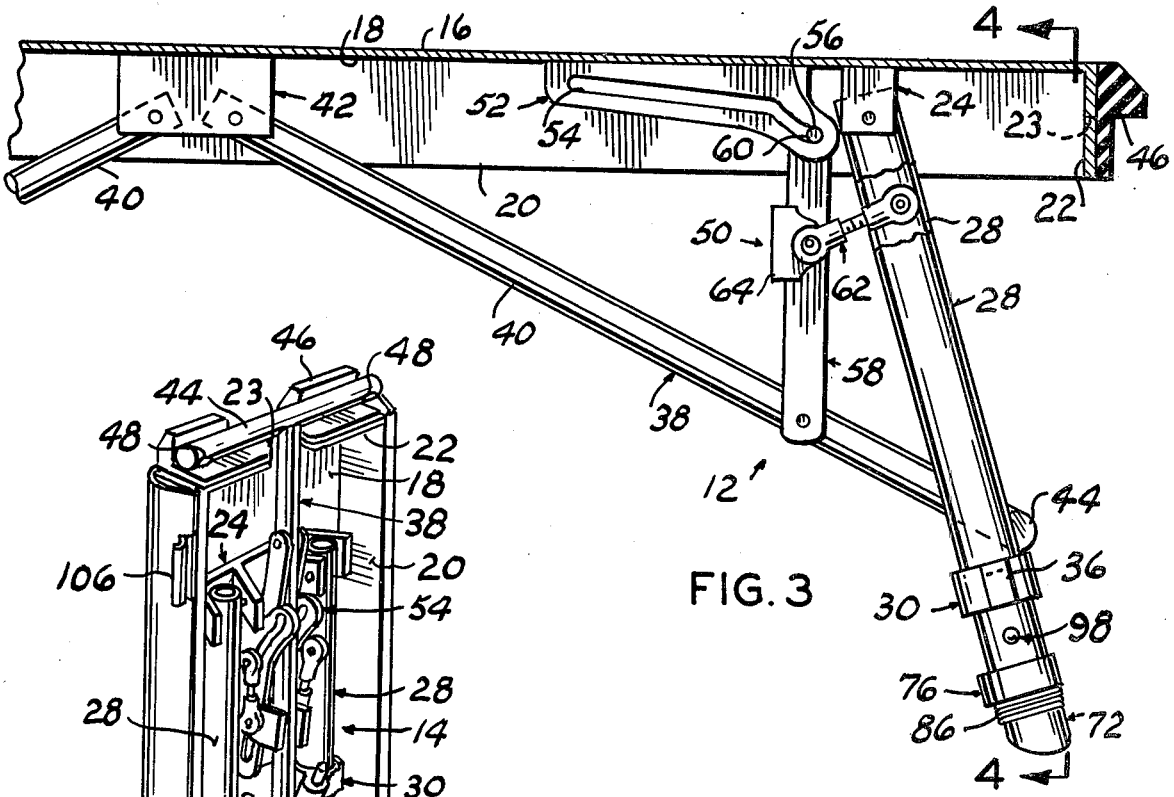
FIG. 3 is a vertical cross sectional view, to a larger scale, partially in elevation, taken substantially along the line 3—3 of FIG. 1.

A strut 58 is pivotally connected at one end with the brace rod stem 40 intermediate its ends and is slidably connected at its other end to the track bracket 52 by a pin 60 extending transversely of the track bracket and slidably supported at its ends within the tracks formed by the bracket slots 54 so that when the legs and brace rod are moved downwardly toward an erected position, as viewed in FIG. 3, the end portions of the pin 60 are disposed in the slot idler area 56 thus stopping further downward movement of the brace rod with respect to the bench underside. The link means further includes a pair of links 62 which are pivotally connected at one end with the upper end portion of the respective bench leg 28 and pivotally connected at their other end with a suitable lug-like bracket 64 secured to opposing sides of the strut 58 intermediate its length. The links 62 act to pivot the legs 28 downwardly from the bench underside 18 when the brace rod 40 is moved downwardly and to stop such leg movement when the pin 60 is disposed in the idler area 56 and the brace rod and legs are disposed in downwardly converging relation thus permitting the brace rod cross bar to be engaged with the lock pins 34. In the example shown, the pair of links 62, each comprise a turnbuckle for the purpose of adjusting its length in accordance with the desired spacing between the respective bench leg and the strut bracket 64. The pivotal connection, at the respective end of each link of the pair of links 62, is a ball joint type connector but may be a universal joint to compensate for lateral movement of the bench legs toward and away from each other during the collapsing and erecting action of the bench legs. The link and track bracket means 50 is activated for a collapsing action of the brace structure 12 by manually lifting the brace rod cross bar 44 off the lock pins 34 which moves the strut pin 60 out of the slot idler area 56 so that the pin 60 will slide longitudinally along the slots 54 by continued movement of the brace rod toward the bench underside 18 which disposes the strut 58 and brace rod stem 40 adjacent the bench underside 18 when the brace rod stem is disposed within the bench end wall slot 23 and the brace rod cross bar 44 is frictionally engaged with the brace rod latch element 46 (FIG. 2). Simultaneously with this action the pair of links 62 pivots the pair of legs 28 toward the bench underside to dispose them in parallel spaced relation on opposing sides of the track bracket 52 adjacent the bench underside 18. Conversely, the brace structure 12 is unfolded to a bench supporting position by manually moving the brace rod bar 44 away from the keeper 46 which slidably moves the strut 58 to a substantially vertical position, as viewed in FIG. 3, while simultaneously the pair of links 62 pivot the bench legs 28 to an erected position so that the brace rod cross bar 44 may lockingly engage the lock pins 34.

Figure 5:
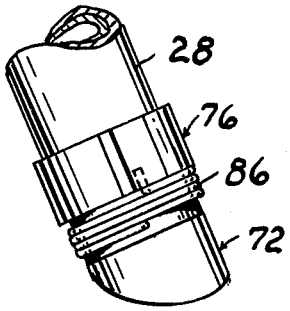
FIG. 5 is a fragmentary elevational view, to a different scale, of the depending end portion of one of the legs.
Figure 4:
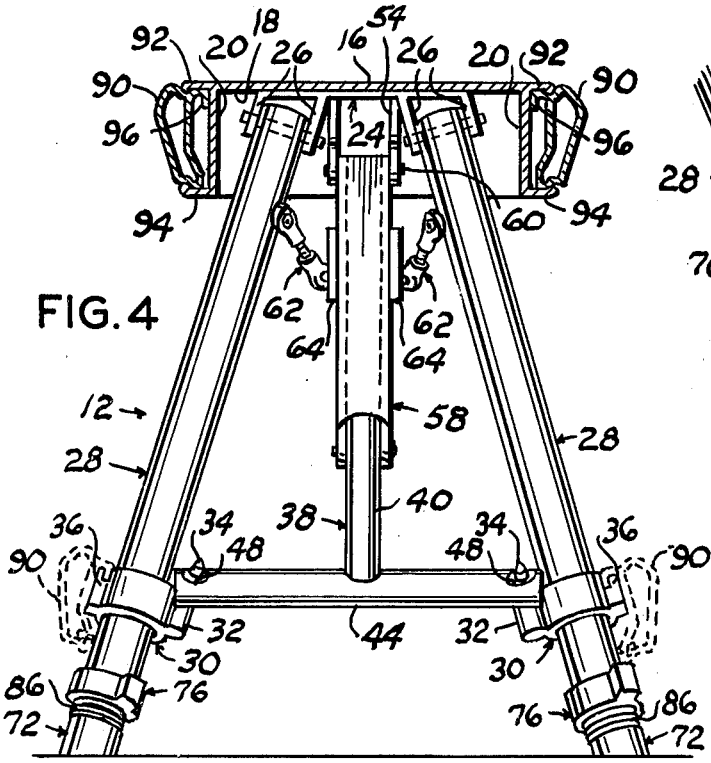
FIG. 4 is a vertical cross sectional view, partially in elevation, looking in the direction of the arrows 4—4 of FIG. 3 and illustrating, by dotted lines, the step rails in step support position.
Figure 6:
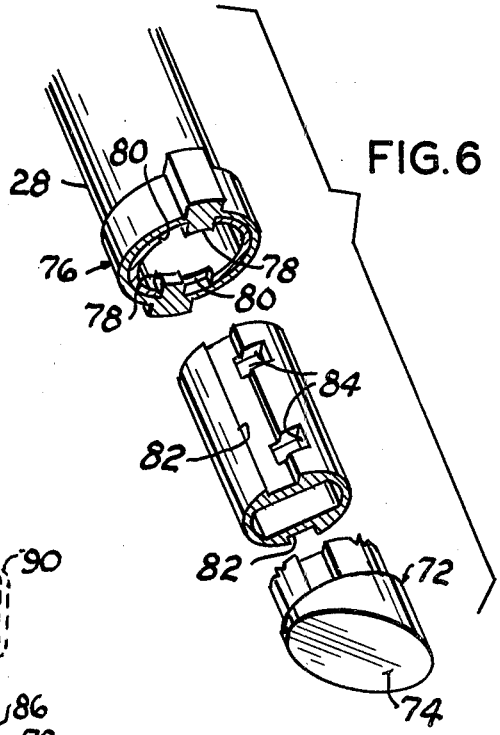
FIG. 6 is a fragmentary exploded perspective view, partially in section, illustrating the manner of releaseably connecting the leg extensions to the legs.

Referring also to FIGS. 5 and 6, each of the legs 28 telescopically receive an inner extension leg 70 having a foot portion 72 coaxially secured to its depending end having a bottom end surface 74 formed on an angle with respect to the longitudinal axis of the respective leg extension for flatly engaging a common supporting surface. The depending end portion of each leg 28 is provided with a lock collar 76 having a pair of diametrically opposed lugs 78 projecting inwardly through apertures 80 formed in the wall of the leg permitting limited rotation of the respective collar 76 about the longitudinal axis of the leg. The lugs 78 are slidably received within a pair of diametrically opposed elongated slots 82 longitudinally formed in the outer surface of the extension leg 70 for longitudinal movement of the latter into and out of the bench leg 28. The extension leg 70 is further characterized by a plurality of cooperating oppositely disposed longitudinally spaced-apart slots 84 communicating with and extending laterally of the leg extension slots 82 for reception of the locking collar lugs 78 maintaining the respective leg extension 70 in a selected telescoped position. The lateral slots 84 are preferably inclined with respect to the longitudinal axis of the extension leg to prevent unauthorized movement of the locking collar lugs 78 out of the slots 84 when the bench is supporting a mass. The locking collar lugs 78 are normally biased into selected diametrically opposite slots 84 by a spring 86 surrounding the depending end portion of the respective bench leg 28 between the respective locking collar 76 and the foot portion 72 with one end of the spring engaged with the locking collar and having its other end secured to the depending end portion of the respective bench leg 28, the locking collar lugs 78 being moved out of engagement with the respective lateral slot 84 by manual rotation of the locking collar 76 against the tension of the spring 86.

Figure 7:
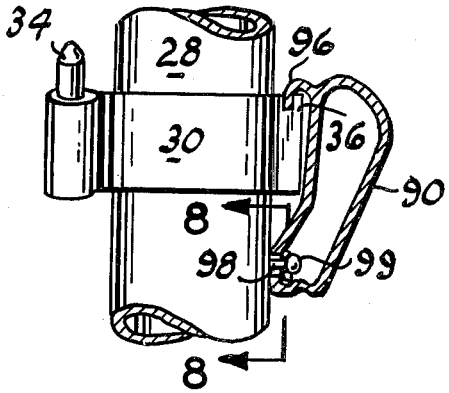
FIG. 7 is a fragmentary elevational view, partially in section, illustrating the manner of connecting the step rails to the legs; and, FIG. 8 is a vertical sectional view taken substantially along the line 8—8 of FIG. 7.
Figure 8:
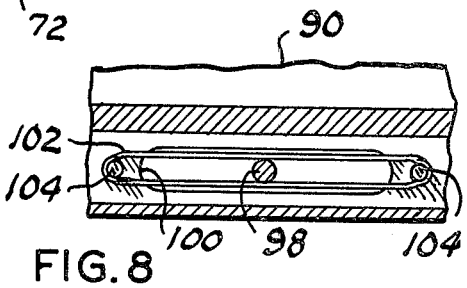

Referring also to FIGS. 7 and 8, the bench 10 is further characterized by a pair of side rails 90 longitudinally frictionally engaged and supported by upper and lower coextensive parallel lip elements 92 and 94 projecting laterally outward in vertically spaced relation from the bench channel legs 20. Each of the side rails 90 are provided with an upper longitudinally coextensive inverted substantially J-shaped hook portion 96 for engagement with the respective fixed collar hook recess 36 for forming a step rail for access to the bench when the leg extensions 70 are telescopically extended, as illustrated by dotted lines (FIG. 1). Each of the legs 28 is provided with a laterally projecting prong 98 normal to its longitudinal axis and disposed between the hook recess 36 and the depending end of the leg for securing the step rails in step forming position. Each of the prongs 98 is provided with a part-spherical head portion 99 opposite the leg. An elongated slot-like prong receiving aperture 100, having a transverse width freely admitting the head portion 99, is longitudinally formed in the surface of the depending portion of the respective step rail overlying and contacting the respective leg. An elongated spring element 102, secured by rivets 104, or the like, to the surface of the step rail, at opposing ends of the aperture 100, projects longitudinally of the aperture in parallel spaced relation. The spacing between the parallel portions of the spring element 102 is slightly less than the transverse width of the aperture 100 for passage of the prong head portion 99 therebetween and frictionally gripping the latter. The respective step rail 90 is provided at its respective ends with a cut-out portion forming hand grips 106 to facilitate disposing the rail in a stored position on the bench channel or in step rail position on the legs.

Obviously the invention is susceptible to changes or alterations without defeating its practicability. Therefore, I do not wish to be confined to the preferred embodiment shown in the drawings and described herein.

I claim:

1. A collapsible bench or horizontal support having a top, comprising:

leg means including at least one leg extending longitudinally of the underside of said top and pivotally connected at one end portion to one end portion of said underside for vertical pivoting movement of the leg other end portion about a horizontal axis toward and away from said underside;

brace rod means including an elongated rod extending longitudinally of said underside and pivotally connected at one end portion to said underside in spaced relation with respect to the connected end of said leg for vertical pivoting movement of the rod other end portion about a horizontal axis toward and away from said underside, said rod other end portion having an aperture;

link and bracket means interconnecting said leg means and said brace rod means with each other and with said underside for simultaneously pivoting said other end portions of said leg and said brace rod in opposing directions toward a downwardly converging juxtaposed position in response to movement of said rod other end portion away from said underside; and, locking means including an outstanding lock pin secured to said leg other end portion for entering the rod aperture and connecting said leg with said brace rod at their convergent position for forming a load bearing structure.

2. Collapsible folding leg and brace structure for a bench or the like having a bench top, comprising:

a pair of bench legs having upper and lower end portions;

bench leg bracket means pivotally connecting the upper end portions of said pair of bench legs to the underside of one end portion of said bench top on transversely aligned inclined axes for disposing the longitudinal axes of said pair of bench legs when erected in downward lateral and longitudinal diverging relation relative to said bench top, each leg of said pair of bench legs having a fixed collar surrounding its lower end portion;

an upstanding lock pin supported by each said fixed collar;

a brace rod projecting longitudinally of said bench between said pair of bench legs and having one end pivotally connected with said underside for vertical movement of its other end portion toward and away from said top one end portion, the brace rod other end portion having a cross bar provided with an aperture in its respective ends for receiving said lock pins in a bench leg erected locking action; and, link and track bracket means pivotally connecting an intermediate portion of said brace rod with the upper end portions of said pair of bench legs and with said underside for pivoting said pair of bench legs from an erected position to a parallel stored position against said underside and vice versa by vertical movement of said brace rod.

3. The leg and brace structure according to claim 2 in which said link and track bracket means includes:

a track bracket connected with said underside between said bench leg bracket means and the pivotal connection of said brace rod with said underside;

a strut pivotally connected at one end with said brace rod and slidably connected at its other end with said track bracket; and, link means extending between and pivotally connecting the upper end portions of said pair of bench legs with said strut.

4. The leg and brace structure according to claim 3 in which said track bracket includes:

at least one depending bracket leg extending longitudinally along said underside and having a longitudinally extending transverse slot generally inclined with respect to the plane of said underside; and, a strut pin connected with said other end of said strut and slidably received by the track bracket slot.

5. The leg and brace structure according to claim 4 in which said link means further includes:

a pair of links extending between and pivotally connected with said strut and the respective leg of said pair of bench legs.

6. The leg and brace structure according to claim 5 in which each link of said pair of links comprises a turnbuckle.

7. The leg and brace structure according to claim 5 in which said pair of bench legs are tubular and further including:

an extension leg telescopically received by each said bench leg; and, rotatable collar means surrounding the depending portion of each said bench leg, each said rotatable collar means including a lug projecting inwardly through the wall of the respective said bench leg for supporting said extension leg in a telescoped position.

8. The leg and brace structure according to claim 7 in which each said extension leg is provided with a coextensive longitudinal slot slidably receiving said collar lug, each said extension leg further having a plurality of longitudinally spaced-apart lateral slots communicating with the longitudinal slot for receiving said collar lug; and, spring means surrounding the depending end portion of each said bench leg for biasing said collar lug into one of the extension leg lateral slots.

9. The leg and brace structure according to claim 8 in which each end portion of said underside is provided with said folding leg and brace structure and each said fixed collar is provided with a lateral upwardly open hook recess and further including:

a step rail coextensive with and normally supported by marginal edge portions of said bench top, said step rail having a J-shaped hook portion for engaging said hook recesses in step rail supporting relation when said bench legs are erected; and, fastener means securing said step rail to the respective said bench leg when in step forming position.

10. A collapsible bench or horizontal support having a top, comprising:

leg means including at least one leg extending longitudinally of the underside of said top and pivotally connected at one end portion to one end portion of said underside for vertical pivoting movement of the leg other end portion about a horizontal axis toward and away from said underside, said leg having a lug-like extension on its said other end portion;

brace rod means including an elongated rod extending longitudinally of said underside and pivotally connected at one end portion to said underside in spaced relation with respect to the connected end of said leg for vertical pivoting movement of the rod other end portion about a horizontal axis toward and away from said underside;

link and bracket means interconnecting said leg means and said brace rod means with each other and with said underside for simultaneously pivoting said other end portions of said leg and said brace rod in opposing directions toward a downwardly converging juxtaposed position in response to movement of said rod other end portion away from said underside; and, locking means including a lock pin on said brace rod other end portion for engaging the lug-like extension and connecting said leg with said brace rod at their convergent position for forming a load bearing structure.

11. Collapsible folding leg and brace structure for a bench or the like having a bench top, comprising:

a pair of bench legs having upper and lower end portions;

bench leg bracket means pivotally connecting the upper end portions of said pair of bench legs to the underside of one end portion of said bench top on transversely aligned inclined axes for disposing the longitudinal axes of said pair of bench legs when erected in downward lateral and longitudinal diverging relation relative to said bench top, each leg of said pair of bench legs having a lug-like extension on its lower end portion;

a brace rod projecting longitudinally of said bench between said pair of bench legs and having one end pivotally connected with said underside for vertical movement of its other end portion toward and away from said top one end portion, the brace rod other end portion having a cross bar provided with a lock pin at its respective ends for engaging said lug-like extensions in a bench leg erected locking action; and, link and track bracket means pivotally connecting an intermediate portion of said brace rod with the upper end portions of said pair of bench legs and with said underside for pivoting said pair of bench legs from an erected position ot a parallel stored position against said underside and vice versa by vertical movement of said brace rod.

* * * * *